United States Patent [19]

Vollweiler

[11] Patent Number: 4,653,336

[45] Date of Patent: Mar. 31, 1987

[54] COMBINATION SOIL AUGER AND SOIL CORE SAMPLER WITH SAMPLE RETAINING CAPACITY

[76] Inventor: Arthur R. Vollweiler, 105 Harrison, American Falls, Id. 83211

[21] Appl. No.: 851,586

[22] Filed: Apr. 14, 1986

[51] Int. Cl.[4] ..... G01N 1/04

[52] U.S. Cl. ..... 73/864.44

[58] Field of Search ..... 73/864.43, 864.44, 864.45, 73/864.51, 864.91; 175/403, 404, 405, 20

[56] References Cited

U.S. PATENT DOCUMENTS

| | | | |
|---|---|---|---|
| 1,109,446 | 9/1914 | Melberg | 73/864.44 |
| 3,162,256 | 12/1964 | Meinecke | 73/864.44 |
| 3,273,930 | 9/1966 | Gottfried | 73/864.44 |
| 3,696,873 | 10/1972 | Anderson | 175/20 |

FOREIGN PATENT DOCUMENTS

| | | | |
|---|---|---|---|
| 634680 | of 1936 | Fed. Rep. of Germany | 175/20 |
| 0398859 | 9/1973 | U.S.S.R. | 73/864.44 |

*Primary Examiner*—Michael J. Tokar
*Assistant Examiner*—Robert R. Raevis
*Attorney, Agent, or Firm*—K. S. Cornaby

[57] ABSTRACT

A combination soil auger and soil core sampling apparatus has a cylindrical body with soil-cutting blades disposed at one end thereof and alternative cap and handle combinations attached at the opposite end for soil auger or soil core sampling use. In the soil auger mode, the body has an open cap with a bail and handle for augering into soil. In the core sampling mode, the body had a closed cap and handle combination and a removable sleeve insert within the body adapted to receive and hold a soil sample as the apparatus is rotated in the soil to be sampled. The sleeve insert is removeable for capping and retention of the soil sample.

5 Claims, 6 Drawing Figures

COMBINATION SOIL AUGER AND SOIL CORE SAMPLER WITH SAMPLE RETAINING CAPACITY

BACKGROUND OF THE INVENTION

This invention relates to core samplers for taking soil samples and having the capability for retaining discrete samples.

Soil augers and related devices for taking core samples of soil have been known in the prior art for many years. In addition, several types of core samplers have been developed with provisions for collecting discrete samples of soil in soil-retaining receptacles for later analysis. Examples of such prior art samples include U.S. Pat. Nos. 1,109,446; 4,096,749; 4,345,484; and 4,498,547.

While both core samplers and soil augers for drilling holes or shafts in soil have been known as noted above, there has been no provision made for a combination of soil auger and soil sample retaining core sampler. Heretofore, if one wanted to engage in both core sampling and drilling a shaft to a predetermined level before taking a sample, it was necessary to carry two separate tools; namely, a soil auger and a soil core sampler. In the field, this has proven to be a cumbersome, expensive and time-consuming requirement for a professional who desires to be fully equipped to take the necessary variety of samples at all depths and under all field conditions. This has been the case especially with the advent of core sampling of nuclear-contaminated areas, and the requirement to monitor continuously the degree and geographical extent of contamination at a particular location.

Accordingly, it is an object of this invention to provide a combination soil auger and soil core sampling device.

It is a further objective to provide a combination soil auger and core sampler having means for retaining discrete soil samples.

It is also an objective to provide a combination soil auger and core sampler having means for taking and retaining successive discrete soil samples.

It is an additional objective to provide means for sealing each discrete soil sample for later analysis.

These and other objectives will become apparent from the description of the invention as follows.

SUMMARY OF THE INVENTION

A combination soil auger and core sampler of the invention has a cylindrical body tube having hollow bit means at one end thereof for drilling into soil as the tube is rotated. A removeable soil-collecting and retaining cylindrical insert whose exterior dimensions are just smaller than the interior dimension of the body tube is nested inside the body tube to receive and retain a soil sample passing upwardly from the hollow bit means into the insert.

First handle means for rotating the body tube are attached to cap means for removeable attachment to the opposite end of the body tube from the bit means. The cap means seal the upper end of the body tube and retain the soil retaining insert in the body tube. The insert can be removed when full of soil and replaced by an empty insert for further sampling. In a preferred embodiment both ends of the soil-retaining insert can be capped to seal the soil inside the insert for transportation and later analysis.

A second handle means is used for removeable attachment to the upper end of the body tube where the device is to be used as a soil auger. The second means is open in its interior dimension and permits the soil to flow upwardly through the body tube and pass beyond the device without being retained. Preferably the second handle means has an elongate bail means. In a preferred embodiment, both handle means have detachable handle stems to permit extension rods to be used with the handles as the combination soil auger and core sampler is used at extended depths below the surface.

THE DRAWINGS

Preferred embodiments of the invention are illustrated in the attached drawings, in which:

FIG. 1 is a perspective view of the invention showing a cut-away view of the soil-retaining insert and the core-sampler handle and cap;

FIG. 2, a perspective view of the insertion having the soil auger handle attached to the body tube;

FIG. 3, a side elevational view of the invention, showing the soil auger handle attached to the body tube;

FIG. 4, a side elevational section of the embodiment shown in FIG. 2 taken along Line 4—4 of FIG. 2;

FIG. 5, a side elevational section of the invention showing the core sampling handle and cap attached to the body tube; and FIG. 6, a side elevational section of the embodiment shown in FIG. 1, taken along Line 6—6 of FIG. 1.

DETAILED DESCRIPTION OF THE ILLUSTRATED EMBODIMENTS

Figure 1:
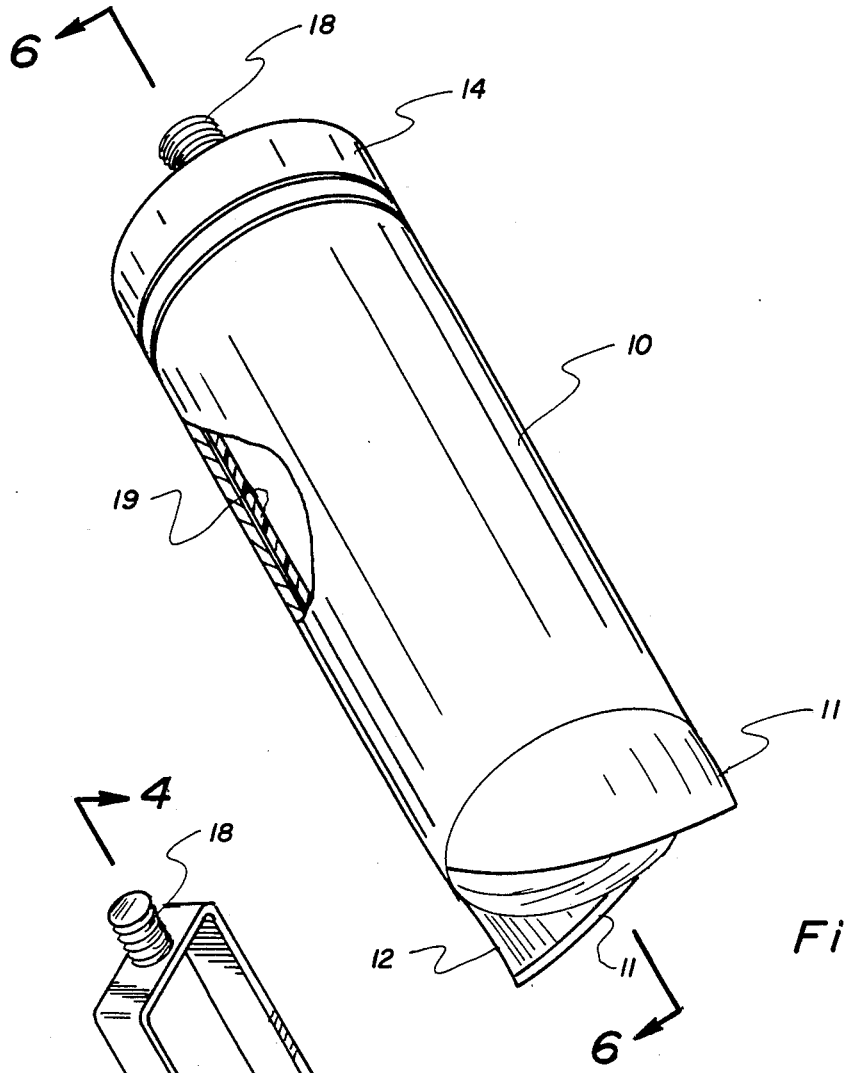
Figure 2:
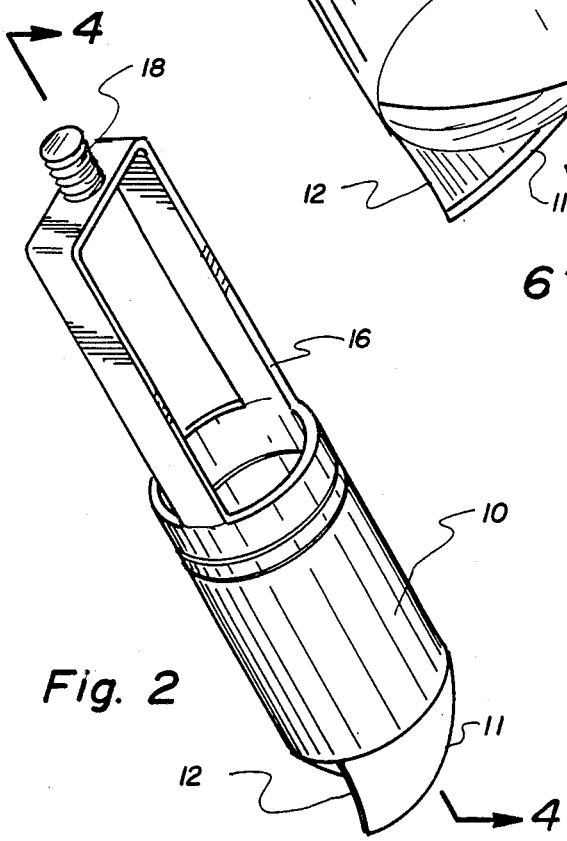

As illustrated in FIGS. 1 and 2 one embodiment of the combination soil auger and soil core sampler has a cylindrical outer shell or body tube 10 composed of an appropriate hard metallic substance or themoplastic material able to withstand repeated use in soil of all types and consistencies. Means for cutting through soil, which in this embodiment comprises a pair of mutually opposing semi-circular blades 11, are attached to one end of a body tube 10, designated the lower end since it is the tube end extending into the soil when in use. Circular blades 11 have opposing sharp edges 12 to facilitate cutting through the soil to loosen it for movement upwardly through body tube 10 when the tube and cutting means are rotated, preferably in a clockwise direction. Cutting blades 11 are preferably cupped inwardly as shown in the drawings to move the loosened soil upwardly within the blades.

Figure 3:
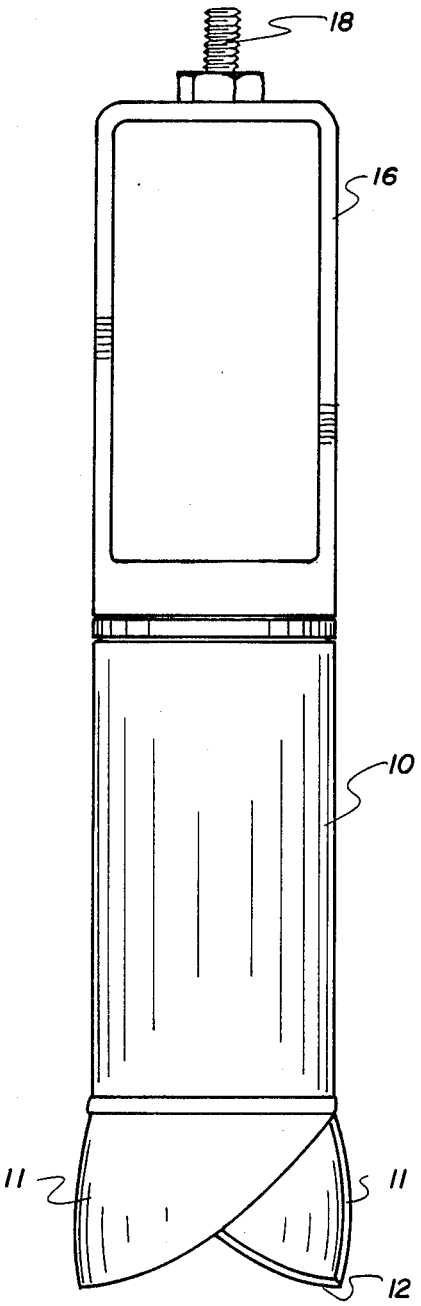
Figure 4:
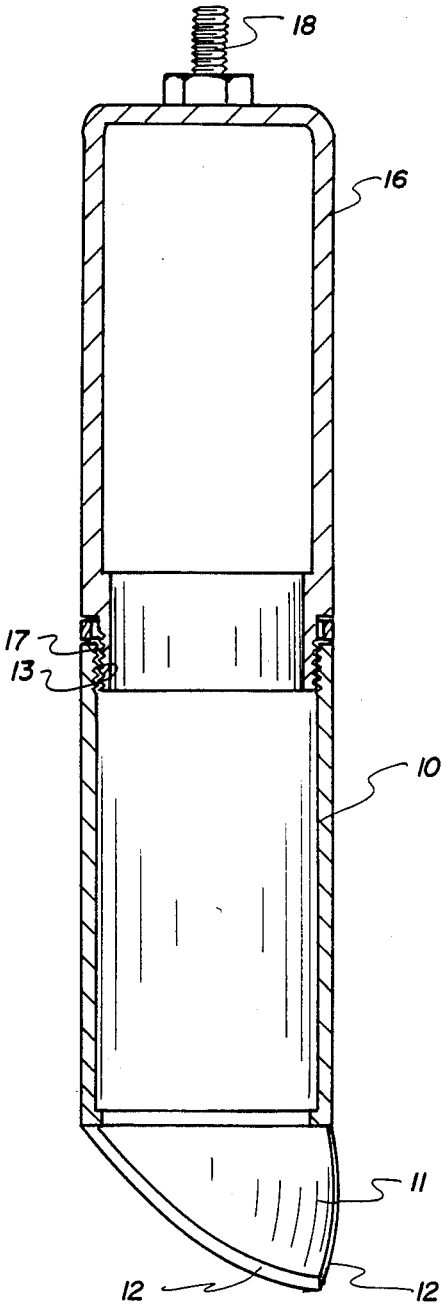
Figure 5:
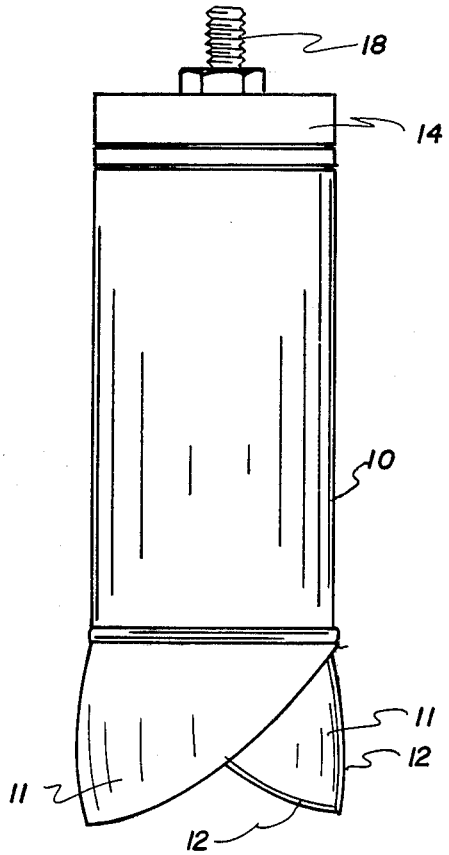
Figure 6:
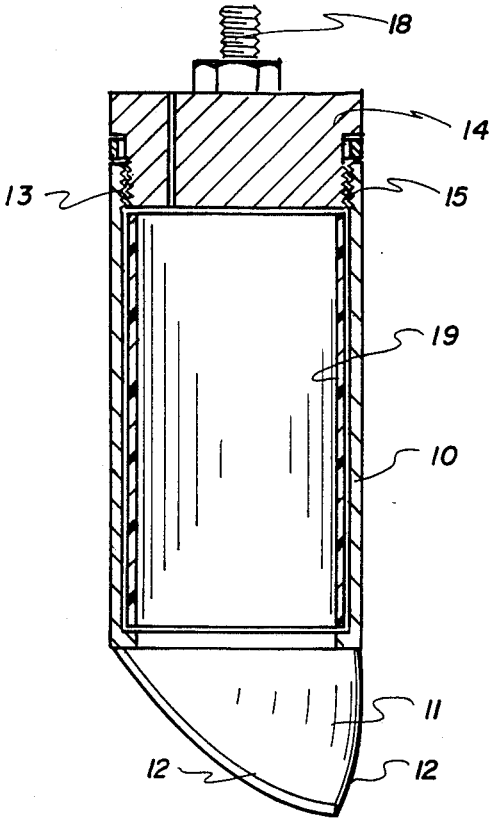

The top end of body tube 10, opposite the end having the mounted cutting blades, is preferably threaded within an inside thread 13, most clearly shown in FIGS. 4 and 6, to accommodate the mounting of the core sampler cap and handle 14, as shown in FIGS. 1, 5, and 6, which has outside threads 15 to accommodate body tube threads 13. Body tube threads 13 also accommodate the second handle means for the soil auger shown in FIGS. 2, 3 and 4, which means in this embodiment comprise a combination open bail and handle 16. Bail and handle combination 16 has outside threads 17 to accommodate the inside threads 13 of body tube 10. In both bail and handle combination 16 and cap and handle combinations 14, the handle in this embodiment comprises a threaded bolt 18 which can be connected to a plurality of successive extensions of a manual handle or motorized rotational means for rotating the device in the soil to be sampled. In the auger mode, the unwanted soil is passed upwardly through the open bail, and the apparatus with the loose soil is lifted from the core hole to dispose of the soil before placing the apparatus back into the hole.

The embodiment used for core sampling is best illustrated in FIGS. 1 and 6, in which body tube 10 has a cylindrical receptacle sleeve 19 slideably disposed within the cylindrical walls of tube 10. Sleeve 19 is adapted to receive and retain a soil sample moving upwardly within cutter blades 11 and into sleeve 19, which is in open communication at its lower end with cutter blades 11. Cap 14 when attached in place over the upper end of tube 10 seals the top end of receptacle sleeve 19, thereby preventing soil from escaping from receptacle 19.

In use, when receptacle sleeve 19 is full or contains the necessary amount of soil for the sample, the core sampler is withdrawn from the hole and cap 14 removed. Sleeve 19 can then be removed and capped at both ends to preserve the core sample intact and undisturbed for transportation and later analysis. A replacement sleeve 19 can then be inserted into body tube 10 and cap 14 reattached. The device is ready for immediate use in obtaining another core sample.

Sleeve 19 can be constructed of any material suitable for holding a soil sample, such as thermoplastic materials, stainless steel and the like. The dimensions of the sleeve 19 and body tube 10 are not critical, except tubes over 5 inches in diameter can get unwieldy if rotated by hand.

While this invention has been described and illustrated herein with respect to preferred embodiments, it is understood that alternative embodiments and substantial equivalents are included within the scope of the invention as defined by the appended claims.

I claim:

1. Combination soil auger and soil core sampler apparatus comprising in combination:

hollow cylindrical body tube means having blade means at a lower end thereof for digging into soil when rotated and forcing loose soil upwardly into the interior of the body tube means;

hollow cylindrical sleeve means slideably disposed within said body tube means for receiving and retaining soil moving upwardly into said body tube means from said blade means;

a first alternative cap means removeably attached to the upper end of said body tube means for stopping the upward motion of soil within the sleeve means;

handle attachment means secured to the first alternative cap means for attaching a handle for rotating the body tube and blade means;

a second alternative cap means for removeable attachment to the upper end of the body tube means, said second alternative cap means having an aperture therein for permitting upwardly moving soil to move out of the upper end of the body tube means; and second handle attachment means secured to the second alternative cap means for attaching a second handle for rotating the body tube means and blade means.

2. Combination apparatus as set forth in claim 1 wherein said cylindrical sleeve means is constructed of thermoplastic material.

3. Combination apparatus as set forth in claim 1, wherein said cylindrical sleeve means has removeable cap means for each respective end of said cylindrical sleeve means.

4. Combination apparatus as set forth in claim 1, wherein said cylindrical sleeve means is not present in the body tube when said second alternative cap means is employed.

5. Combination apparatus as set forth in claim 1, wherein said body tube is constructed of stainless steel.

* * * * *